United States Patent [19]

McKinnon et al.

[11] Patent Number: 5,023,764

[45] Date of Patent: Jun. 11, 1991

[54] STROBOSCOPIC LAMP OPTICAL SYSTEM

[75] Inventors: Donald C. McKinnon; Thomas F. Gauthier, both of Cheboygan, Mich.

[73] Assignee: Ferret Instruments, Inc., Cheboygan, Mich.

[21] Appl. No.: 431,535

[22] Filed: Nov. 3, 1989

[51] Int. Cl.[5] ..... F21V 7/12

[52] U.S. Cl. ..... 362/299; 362/301; 362/346; 362/328

[58] Field of Search ..... 362/157, 208, 341, 346, 362/347, 349, 16, 335, 208, 297, 299, 300, 301, 327, 328

[56] References Cited

U.S. PATENT DOCUMENTS

| | | | |
|---|---|---|---|
| 979,852 | 12/1910 | Harrison | 362/317 |
| 1,367,472 | 2/1921 | Harvey | 350/613 |
| 1,691,131 | 11/1928 | Ryder | 362/348 |
| 2,067,256 | 1/1937 | Brush | 324/385 |
| 2,259,910 | 10/1941 | Rylsky | 362/26 |
| 2,286,030 | 6/1942 | young et al. | 358/23 |
| 2,907,873 | 10/1959 | Smith | 362/320 |
| 3,449,035 | 6/1969 | Denaro | 350/6.91 |
| 3,471,236 | 10/1969 | Pearson | 356/24 |
| 4,135,228 | 1/1979 | Lones | 362/297 |
| 4,141,059 | 2/1979 | Shiojiri | 362/16 |
| 4,317,625 | 3/1982 | Van Allen | 362/16 |
| 4,333,127 | 6/1982 | Alkema et al. | 362/346 |
| 4,356,533 | 10/1982 | Takematsu | 362/16 |
| 4,380,026 | 4/1983 | Kubota | 358/106 |
| 4,412,276 | 10/1983 | Blinow | 362/16 |
| 4,460,942 | 7/1984 | Pizzuti et al. | 362/16 |
| 4,462,063 | 7/1984 | English | 362/335 |
| 4,504,889 | 3/1985 | Goldfarb | 362/328 |
| 4,507,254 | 3/1985 | Daniels et al. | 362/16 |
| 4,530,035 | 7/1985 | Kawarada | 362/208 |
| 4,530,040 | 7/1985 | Petterson | 362/328 |
| 4,570,203 | 2/1986 | Daniels et al. | 362/347 |
| 4,699,497 | 10/1987 | Hinton et al. | 355/3 R |

*Primary Examiner*—Stephen F. Husar
*Assistant Examiner*—Sue Hagarman
*Attorney, Agent, or Firm*—Krass & Young

[57] ABSTRACT

The invention pertains to a stroboscopic timing light for use with internal combustion engines. The reflector assembly is designed to increase the proportion of light from a flash tube that becomes part of a focused light beam. The reflector assembly comprises a pair of angled reflectors or series of reflectors forming a frusto-pyramid-like structure which reflects an array of images of a flash lamp. These images reflect the substantial portion of the light from the flash lamp while providing a cost effective and relatively inexpensive reflector assembly.

26 Claims, 2 Drawing Sheets

STROBOSCOPIC LAMP OPTICAL SYSTEM

FIELD OF THE INVENTION

The present invention relates to an improved. stroboscopic timing light assembly for use in timing the ignition system of an automobile motor or similar internal combustion engine.

BACKGROUND OF THE INVENTION

Internal combustion engines require specific ignition timing patterns to maintain peak running condition. Most such engines have external means for verifying the timing pattern of the ignition system. Usually, a mark on an external flywheel rotates into alignment with one of a series of marks fixed on the engine block. To determine the ignition timing, an ignition timing light connects to the first ignition spark plug through an inductive coupling. In this manner, the timing light produces a flash of light each time the first spark plug fires as the engine runs. This flash of light is manually directed onto the flywheel and the engine to illuminate the flywheel and engine marks. The flash of light creates a stroboscopic effect which appears to freeze the flywheel mark in relation to the fixed marks. The relationship of these marks indicates the condition of the ignition timing. Based on that relationship, the timing can then be adjusted by means well known in the industry.

Generally, timing lights employ a lens to project light into a narrow beam. A lens, without a reflector, only captures a small percent of available light from the flash lamp. Variously shaped reflectors are sometimes employed behind the flash lamp to direct more of the available light into the beam. Until now, timing light reflectors have not been effectively coordinated with the lens so that much of the available light was lost. A parabolic reflector can be used to capture most of the available light and project it into a useable beam; however, parabolic reflectors are large and thus are generally not employed in timing lights because of the need for a narrow beam and light source.

The present invention is directed to projecting the substantial majority of available light from the flash lamp into a usable spotlight beam.

SUMMARY OF THE INVENTION

There is disclosed herein an improved stroboscopic timing light for use with internal combustion engines. The timing light comprises a pistol shaped housing which aligns a flash lamp, reflector assembly, and lens along an optical axis for projecting the beam of light. A cylindrical flash lamp, preferably having a light diffusing surface, provides the source of light and is positioned along the optical axis substantially enclosed within the reflector assembly. The optical axis substantially corresponds to the line of sight of the pistol shaped housing, providing for directional control of the beam of light. The housing further retains and protects the timing light circuitry. The timing light is powered by the electrical system of the internal combustion engine and further inductively connects to a specific spark plug wire to produce a flash of light each time that specific spark plug fires in a manner well known in the industry.

Preferably the reflector assembly is composed of one piece of reflective metal. A pair of side reflectors are formed by shaping the single piece of reflective metal about the cylindrical axis of the flash lamp. This provides a pair of angled reflecting surfaces disposed on either side of the flash lamp. Preferably a second pair of reflectors are orthoginally disposed proximate the first pair to form a reflector assembly in the form of a frusto-pyramid-like structure. The flash lamp is then enclosed within the reflector assembly proximate the relatively small cross section end of the frusto-pyramid-like structure. The reflector assembly thereafter increases in cross section providing increased reflective surfaces directed substantially forward about the optical axis.

The reflector assembly preferably contacts the flash lamp to provide a heat sink. In a first preferred embodiment the single piece of reflective metal forms a curve which substantially corresponds to the curve of the outer surface of the flash lamp. The flash lamp, in this embodiment, then mates with the reflector assembly on the rear face of the flash lamp. Alternatively, the single piece of the reflective metal is bent to provide a planar back reflective surface perpendicular to the optical axis. In this embodiment, the flash lamp contacts the reflector assembly at only a few distinct points.

Further, the reflector assembly obtains a flared shape apart from a strict frusto-pyramid configuration. By flaring the reflector elements at its outside edge the reflected image array is compressed at its edges, which intensifies the contrast of the edges of the beam helping to form a more definite reflection.

BRIEF DESCRIPTION OF THE DRAWINGS

These and other features and aspects of the present invention will become clear from the following detailed description of the invention in which.

DETAILED DESCRIPTION OF THE INVENTION

Figure 1:
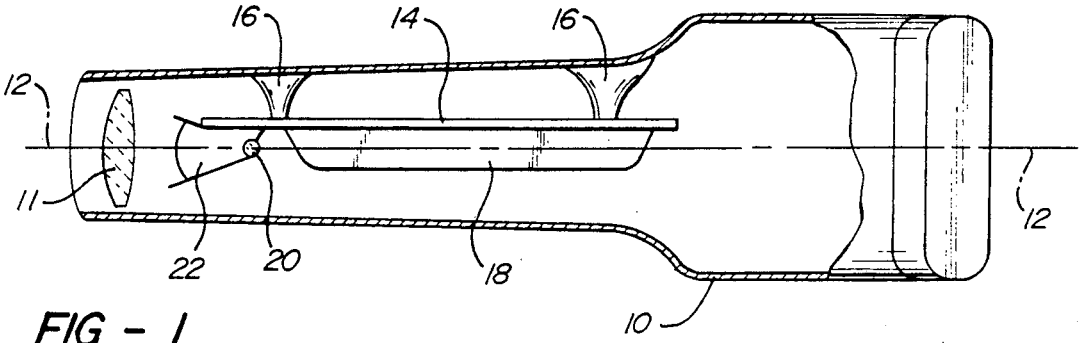
FIG. 1 is a cutaway top view of the invention as mounted in the timing light housing.

The present invention provides a reflector assembly in which the substantial portion of the lamp light is directed forward from a compact and well-defined reflected image array. The reflector assembly forms reflected flash lamp images from light which would not otherwise be captured by a planar reflector.

As illustrated with reference to FIG. 1, a housing 10 supports and protects the stroboscopic timing light components and is further disposed about optical axis 12 for directional aiming. A PC board 14 mounted on attachment posts 16 provides the base for the timing light circuitry 18. The flash lamp 20 and reflector assembly 22 are aligned along optical axis 12 with lens 11. In this arrangement, the light directly from flash lamp 20 and light reflected by reflector assembly 22 projects forward through lens 11 along optical axis 12.

Figure 2:
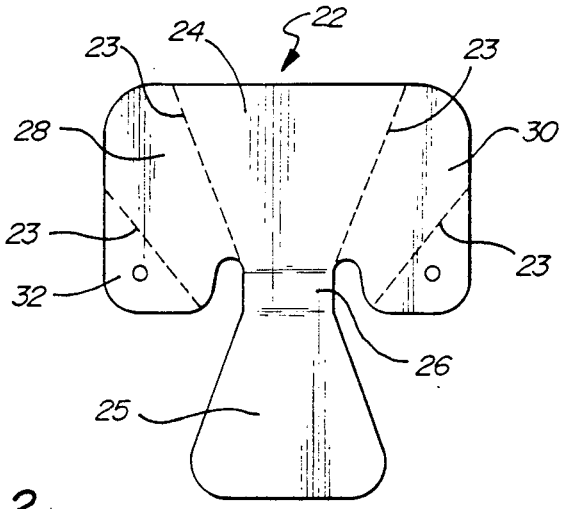
FIG. 2 is an outline of a reflector assembly as cut from one piece of reflective material prior to FIG. 3 is a overhead view of the reflector assembly after being formed from a single sheet of material.

As illustrated with reference to FIG. 2, the reflector assembly 22 is formed from a single piece of reflective material, preferably metallic. The single piece of material is folded along index lines 23 to create a pair of side reflectors 24 and 25 connected by rear reflector 26. Further, a secondary pair of reflectors 28 and 30 connect to anchor tabs 32 after the reflector assembly 22 is formed into its preferred shape.

Figure 3:
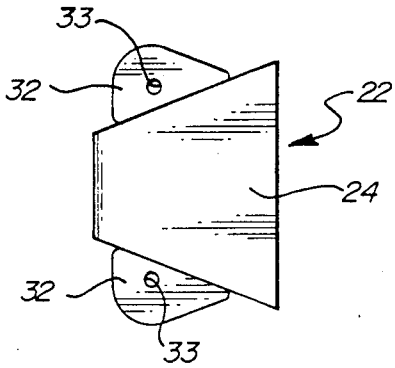
Figure 4:
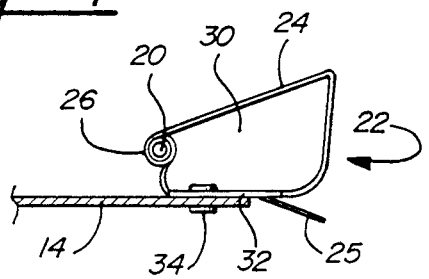
FIG. 4 is a side view of the reflector assembly after being formed from a single sheet of reflective material and mounted to a circuit board.

As illustrated in FIGS. 3 and 4, the arrangement of the formed reflector assembly 22 roughly corresponds to a frusto-pyramid-like structure. Due to the cylindrical shape of the flash lamp 20, the reflector assembly 22 likely has a rectangular opening, corresponding to the base of the frusto-pyramid-like structure. Thus, the reflector assembly does not necessarily conform to a true frusto-pyramid which has a square base.

The single piece of reflective material is shaped to enclose the flash lamp 20 at the end of the frusto-pyramid-like structure having the smaller cross-section. Side reflector 24 and side reflector 25 face forward and form an angle which converges behind the flash lamp 20. They are further connected at attachment sites proximate their base edges by rear reflector 26. Two additional or secondary reflectors 28 and 30 are angled with respect to one another proximate the ends of cylindrical flash lamp 20 and further form an angle which converges behind flash lamp 20. The secondary reflectors 28 and 30 have an orthoginal relationship with the pair of side reflectors 24 and 25 in the reflector assembly 22. These four reflectors substantially form the frusto-pyramid-like structure of the reflector assembly 22. Further, anchor tabs 32 possess openings 33 for attachments means 34 to secure the reflector assembly to the PC circuit board 14.

Preferably, a metallic reflector assembly 22 is used as the flash lamp trigger plate in application of a kilovolt impulse. This eliminates the need for a trigger stripe and terminal which otherwise would have been needed.

Although the previous discussion of reflector assembly 22 specifically recites a folded metal assembly, this is not required to practice the invention. Any substantially reflecting material formed in the shape defined above and as further illustrated in FIGS. 5 and 6 can be employed. In particular, a metal glazed ceramic structure can be used.

As illustrated with reference to FIGS. 5 and 6, the angular relationship with each of reflectors determines the size of the reflected image array. Flash lamp 20 and lens 11 are disposed along optical axis 12 for the reflector assembly 22. The angle (A) of the pair of reflectors and the diameter (D) of the flash lamp 20 determine the width of the array of reflected images 36. The reflected images centers 36 are formed into a circular array of radius (R) as defined by the angle (A) and the diameter (D) of the light source, as expressed by:

$$R = \frac{D}{2 \sin (A/2)}$$

From this formula it can be seen for a given diameter flash lamp 20, as the angle increases the radius of the array of reflected images 36 decreases. In keeping with this concept it is preferable to flare each reflector away from one another at their ends (as illustrated by dashed lines 38) which provides an increasing angle between the pair of reflectors and compresses the reflected images 36 at their outer edges. This effect tends to intensify the contrast of the edges of the beam and forms a more definite reflective image 36 at the outer edge. The lens 11 preferably remains of small diameter for physical access through the narrow passages between internal combustion engine components. Any lens 11 has an effective aperture for capturing light. Due to the small size of lens 11, the reflector must be dimensioned to place the maximum available light inside the lens 11 aperture. The flaring of reflectors aids this goal. The lens aperture concept will be discussed in detail hereinafter.

The back reflector preferably assumes one of two alternative embodiments. With reference to FIG. 5, a planar rear reflector 26 is disposed perpendicular to the optical axis 12 and contacts the flash lamp 20 at contact point 40. This planar rear reflector 26 is attached to the pair of side reflectors 24 and 25 which contact the flash lamp 20 at contact points 42. This embodiment provides a series of overlapping reflected images 44 behind the flash tube 20. Alternatively, with reference now to FIG. 6, a curved rear reflector 26 can be utilized. This contacts the flash lamp 20 over substantial portion of its surface between contact sites 46. The reflected image 48 of the curved rear reflector 26 will appear distorted behind flash lamp 20, and appear from any angle to remain directly behind the flash lamp 20. This tends to distribute the lamp light across the image area. In either embodiment contact between the rear reflector 26 and the flash lamp 20 is preferred to provide a heat sink for flash lamp 20. In use, however, the rear reflector 26 and side reflectors 24 and 25 do not necessarily contact the flash lamp 20 if a heat sink is not required. As long as the side reflectors 24 and 25 remain within a distance of approximately one half the diameter of flash lamp 20, the reflected image array will effectively transmit light as will be disclosed further hereinafter.

Figure 5:
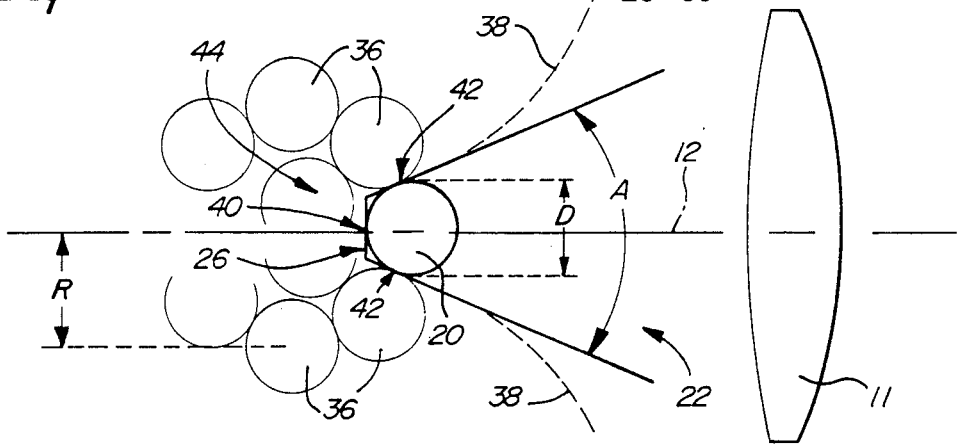
FIG. 5 is a reflector image diagram of the invention with a planar rear reflector.
Figure 6:
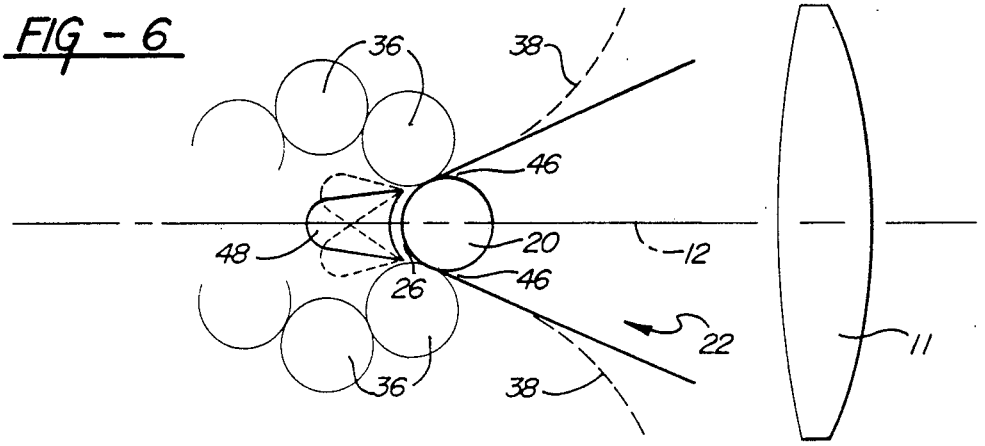
FIG. 6 is a reflector image diagram of the invention with a curved rear reflector.

FIGS. 5 and 6 illustrate two gradations within a range of gradations for rear reflector 26. The extremes include merely extending reflectors 24 and 25 to their joining point and the curved rear reflector 26 illustrated in FIG. 6. FIG. 5 is merely a particular one of the intermediate possibilities. Other intermediate gradations of rear reflector 26 are also possible within the scope of the invention.

The dimensions of the lens 11, lamp 20 and reflector assembly 22 preferably are kept proportional to one another. Lens 11 has an effective aperture dependant on its size. Lens 11 preferably remains small for physical access through narrow openings. This correspondingly limits the size of the reflected image array which will be captured by the lens aperture. Therefore, for any given lens 11, there is a maximum reflected image array size which will be within the aperture and projected through the lens 11.

Figure 7:
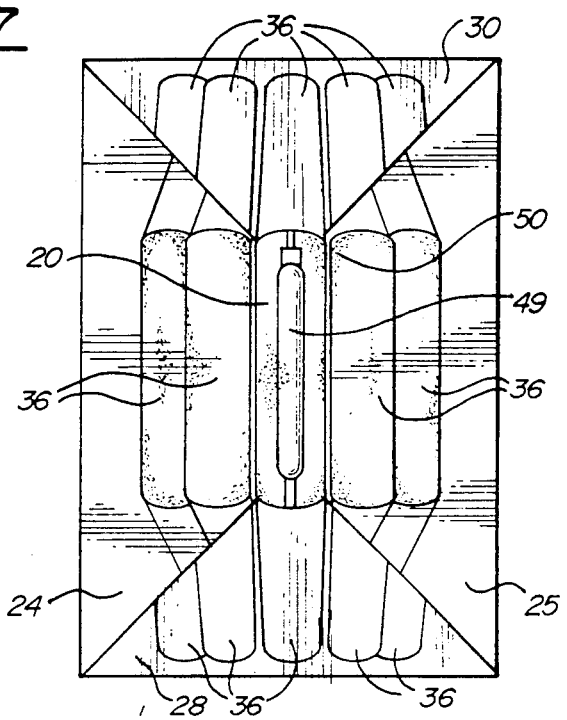
FIG. 7 is a view along the optical axis of the reflected images.

As illustrated with reference to FIG. 7, flash lamp 20 with arc path 49 is disposed proximate the center of reflector assembly 22 upon view from a position along optical axis 12. This arrangement produces an array of reflected images 36 in each of the reflectors.

Flash lamp 20 is an industry standard cylindrical xenon flash tube having a small arc path 49 length and tube diameter. The cylindrical nature of flash lamp 20 makes it desirable that the array of reflected images 36 possess the same width as the height of the flash lamp 20 in the pair of side reflectors 24 and 25. In an exemplary embodiment, cylindrical flash lamp 20 has a diameter of 3.5 mm and an arc path 49 length of 10 mm. From the previously stated formula and with reference to FIG. 5, to achieve a diameter of reflected images 36 of 10 mm, equal to the length of the flash lamp cylinder 20, the angle between the side reflectors 24 and 25 should equal 41 degrees. In this configuration, the pair of side reflectors 24 and 25 create a uniform block of reflected light substantially corresponding to the effective aperture of lens 11. The additional reflectors 28 and 30 similarly reflect images 36. However, since the reflected images 36 in the additional reflectors 28 and 30 generally fall outside the effective aperture of lens 11 and are at a distance beyond the focal length, these reflected images add little to the eventual beam of light. The substantial majority of reflected light comes from side reflectors 24 and 25, which thusly can be used alone.

The use of a diffused surface on flash lamp 20 distributes the distinctiveness of reflected images 36, creating a more uniform light source. This, in turn, creates a more uniform reflected pattern in area 50 of the reflector assembly 22. The goal of the reflector assembly 22 is to place the maximum amount of light within the lens aperture. This is accomplished by having the array of reflected images 36 align contiguously, without leaving space on the reflector assembly 22 unoccupied by reflected light within the lens aperture. This can be accomplished as long as each pair of reflectors (such as 24 and 25) are approximately within one half of the diameter of flash lamp 20 away from flash lamp 20. The reflector assembly 22 preferably contacts the flash lamp 20 to act as a heat sink, however, this is not necessary for the proper reflective array of images 36.

This reflected light, forming a series of reflected images of flash lamp 20, contributes to a beam of light which may be focused through the use of lens 11 (in FIG. 1). The convex lens 11 may be placed to condense and project the light of the flash lamp 20 in reflected images into a narrow beam which can be aimed between hoses and belts on an automobile internal combustion engine. If a lens 11 is not utilized, a broader beam of light results. Because of the increased light output from the reflected images, less power is necessary to deliver the same level of the light to the beam as that of reflectors previously used in the industry. Likewise, use of the same flash energy as that previously used in the industry delivers increased light output to the beam.

Having thus disclosed my invention it will be apparent to one of skill in the art that the present invention may be practiced in many embodiments than those shown herein. The foregoing drawings, description and discussion are merely illustrated with particular embodiments and are not limitations on the practice thereof. It is the following claims, including all equivalents thereof, which define the scope of the invention.

Having thus disclosed my invention, I now claim:

1. An improved stroboscopic timing light assembly, comprising:

a flash lamp;

a pair of planar side reflectors each terminating in a free edge, said pair of forward facing side reflectors being substantially disposed along respective planes which converge at a point to form an acute angle with respect to each other, said flash lamp being disposed between said reflectors proximate said point and spaced therefrom; and a convex projecting lens disposed proximate said free edges, the reflectors, the lamp and the lens being disposed such that a beam of light emitted from said lamp is reflected by said reflectors to create a plurality of images, which are condensed and projected by said lens to create an enhanced image projected from the assembly.

2. The apparatus of claim 1, wherein said improved stroboscopic timing light assembly further comprises:

a back reflector element connecting said pair of side reflectors.

3. The apparatus of claim 1, wherein:

said back reflector element comprises a planar rear reflector disposed substantially perpendicular to said optical axis.

4. The apparatus of claim 2, wherein:

said back of said flash lamp is cylindrical in configuration; and said back reflector element comprises a semicircular rear reflector having substantially the same radius of curvature as said flash lamp and disposed to contact a portion of the surface of said flash lamp.

5. The apparatus of claim 2, wherein said back reflector element is integral with said pair of forward facing side reflectors.

6. The apparatus of claim 1, further comprising:

a pair of secondary reflectors disposed with respect to said pair of forward facing side reflectors to form a frusto-pyramid-like reflector array.

7. The apparatus of claim 6, wherein said pair of side reflectors and said pair of secondary reflectors form a frusto-pyramidal-like reflector array having a substantially rectangular cross section.

8. The apparatus of claim 7, wherein said reflector array is formed out of a single sheet of reflective material.

9. The apparatus of claim 1, wherein said pair of side reflectors are made from metallic reflective material.

10. The apparatus of claim 1, wherein said flash lamp has a light diffusing surface.

11. The apparatus of claim 1, wherein each of said pair of side reflectors further comprise means for mounting said flash lamp.

12. The apparatus of claim 1, wherein each of said side reflectors is disposed one half of the diameter of said flash lamp from said flash lamp.

13. The apparatus of claim 1, wherein said pair of forward facing side reflectors are disposed so as to create an array of contiguous reflected images of the flash lamp.

14. The assembly of claim 1 further comprising a housing for containing the reflectors, the lamp and the lens.

15. An improved stroboscopic timing light assembly comprising:

a cylindrical flash lamp having a diameter D;

a convex projecting lens positioned relative the front side of said flash lamp along an optical axis connecting the centers of said flash lamp and said convex projecting lens; and a pair of planar side reflectors each terminating in a free edge, said pair of forward facing side reflectors being substantially disposed along respective planes which converge at a point to form an acute angle A with respect to each other, said flash lamp being disposed between said reflectors proximate said point, said reflectors acting to reflect a circular image array of said flash lamp, said array having a radius R determined by the relationship:

$$R = \frac{D}{2\sin(A/2)};$$

and a convex projecting lens disposed proximate said free edges such that the reflected image array is projected by said lens to create an enhanced image projected from the assembly.

16. The apparatus of claim 15, wherein each of said pair of side reflectors further comprise means for mounting said flash lamp.

17. The apparatus of claim 15, wherein each of said side reflectors is disposed one half of the diameter of said flash lamp from said flash lamp.

18. The apparatus of claim 15, wherein said pair of forward facing side reflectors are disposed so as to create an array of contiguous reflected images of the flash lamp.

19. The apparatus of claim 15 wherein the pair of side reflectors each comprise a second, non-planar portion which flares out of its respective plane.

20. An improved stroboscopic timing light assembly comprising:

a flash lamp;

a convex projecting lens arranged along a optical axis for projecting a beam of light emitted form said flash lamp;

a single sheet of reflective material bent along fold lines formed thereon to form;

a pair of primary reflectors substantially conforming to a first pair of opposed sides of a frusto-pyramid-like structure and located on opposite sides of said optical axis, said pair of primary reflectors including short ends which are positioned proximate said flash lamp and long ends which are positioned proximate said convex projecting lens, a back reflector element positioned behind said flash lamp, and a pair of secondary reflectors substantially conforming to a second pair of opposed sides of a frusto-pyramid-like structure substantially contiguous with said pair of primary reflectors to form a frusto-conical reflector which surrounds said flash lamp.

21. The apparatus of claim 20, wherein:

said back reflector element is formed integral with said pair of primary reflectors.

22. The apparatus of claim 20, wherein:

said flash lamp is cylindrical in configuration; and said back reflector element comprises a semicircular rear reflector having substantially the same radius of curvature as said flash lamp and disposed to contact a portion of the surface of said flash lamp.

23. The apparatus of claim 20, wherein said flash lamp has a light diffusing surface.

24. The apparatus of claim 20, wherein said flash lamp is cylindrical in shape.

25. The apparatus of claim 20, wherein said single sheet of reflective material is metallic.

26. An improved stroboscopic timing light assembly comprising:

a cylindrical flash lamp;

a reflector formed from a single piece of metallic reflective material to form a frusto-pyramidal-like reflector element disposed tangent to said flash lamp, and a semi-circular back reflector element contacting said flash lamp, such that said reflector forms an array of reflected images of said flash lamp; and a convex projecting lens disposed adjacent said frusto-conical reflector element such that said lens gathers the light from said flash lamp and said array of reflected images of said flash lamp to form a beam of light.

* * * * *

UNITED STATES PATENT AND TRADEMARK OFFICE

CERTIFICATE OF CORRECTION

PATENT NO. : 5,023,764

DATED : June 11, 1991

INVENTOR(S) : Donald C. McKinnon/Thomas F. Gauthier

It is certified that error appears in the above-identified patent and that said Letters Patent is hereby corrected as shown below:

On the title page:

Under U.S. Patents Documents, Please add the following:

--4,146,833 McKinnon
3,858,113 Pruss
3,497,798 Schick
2,517,302 Groves
52,987 Gibson--.

Claim 20, C7, Line 22, Please delete "form" and insert -- from --.

Signed and Sealed this

Third Day of November, 1992

*Attest:*

DOUGLAS B. COMER

*Attesting Officer*

*Acting Commissioner of Patents and Trademarks*